US007527546B2

(12) United States Patent
Nishihara et al.

(10) Patent No.: US 7,527,546 B2
(45) Date of Patent: May 5, 2009

(54) VISCOELASTIC POLISHER AND POLISHING METHOD USING THE SAME

(75) Inventors: Kazunari Nishihara, Sakai (JP); Tsunemoto Kuriyagawa, Sendai (JP)

(73) Assignee: Panasonic Corporation, Osaka (JP)

( * ) Notice: Subject to any disclaimer, the term of this patent is extended or adjusted under 35 U.S.C. 154(b) by 497 days.

(21) Appl. No.: 10/557,018

(22) PCT Filed: Jul. 9, 2004

(86) PCT No.: PCT/JP2004/010176

§ 371 (c)(1),
(2), (4) Date: Nov. 16, 2005

(87) PCT Pub. No.: WO2005/005100

PCT Pub. Date: Jan. 20, 2005

(65) Prior Publication Data

US 2007/0072519 A1 Mar. 29, 2007

(30) Foreign Application Priority Data

Jul. 10, 2003 (JP) ..... 2003-272632

(51) Int. Cl.
*B24B 1/00* (2006.01)
*B24D 11/00* (2006.01)

(52) U.S. Cl. ..... 451/36; 451/41; 451/59; 451/530; 451/550

(58) Field of Classification Search ..... 451/36, 451/41, 59, 63, 285, 286, 287, 288, 290, 451/490, 530, 533, 550
See application file for complete search history.

(56) References Cited

U.S. PATENT DOCUMENTS

| | | | | |
|---|---|---|---|---|
| 2,819,568 | A * | 1/1958 | Kasick | 451/488 |
| 5,212,910 | A * | 5/1993 | Breivogel et al. | 451/530 |
| 5,558,563 | A * | 9/1996 | Cote et al. | 451/41 |
| 5,718,620 | A * | 2/1998 | Tanaka et al. | 451/288 |
| 6,220,942 | B1 * | 4/2001 | Tolles et al. | 451/65 |
| 6,561,891 | B2 * | 5/2003 | Eppert et al. | 451/530 |
| 6,632,129 | B2 * | 10/2003 | Goetz | 451/533 |
| 6,692,338 | B1 * | 2/2004 | Kirchner | 451/41 |
| 6,913,518 | B2 * | 7/2005 | Chen et al. | 451/41 |
| 7,134,947 | B2 * | 11/2006 | Stark et al. | 451/285 |
| 7,169,014 | B2 * | 1/2007 | Taylor et al. | 451/6 |
| 7,189,155 | B2 * | 3/2007 | Hoshino et al. | 451/527 |
| 2005/0020082 | A1 * | 1/2005 | Vishwanathan et al. | 438/690 |
| 2006/0229008 | A1 * | 10/2006 | Wang | 451/530 |

FOREIGN PATENT DOCUMENTS

| | | | |
|---|---|---|---|
| JP | 54 027196 | | 9/1980 |
| JP | 62099072 | A | 5/1987 |
| JP | 09277163 | A | 10/1997 |
| JP | 09-295255 | | 11/1997 |
| JP | 2002307294 | A | 10/2002 |
| JP | 2003048156 | A | 2/2003 |
| JP | 2003103470 | A | 4/2003 |

* cited by examiner

*Primary Examiner*—Timothy V Eley
(74) *Attorney, Agent, or Firm*—Steptoe & Johnson LLP

(57) ABSTRACT

A viscoelastic polisher to be used for polishing. The viscoelastic polisher includes a viscoelastic layer provided on a major surface of a base disk and having a hole of a predetermined radius formed in a center portion thereof, and the base disk has a plurality of grooves equiangularly provided in the major surface thereof as extending radially outward from a center portion thereof. This arrangement ensures stable supply of an abrasive liquid, and obviates a need for formation of grooves in the viscoelastic layer.

14 Claims, 8 Drawing Sheets

VISCOELASTIC POLISHER AND POLISHING METHOD USING THE SAME

CLAIM OF PRIORITY

This applications claims priority under 35 USC 371 to International Application No. PCT/JP2004/010176, filed on Jul. 9, 2004, which claims priority to Japanese Patent Application No. 2003-272632, filed on Jul. 10, 2003, the entire contents of which are hereby incorporated by reference.

TECHNICAL FIELD

The present invention relates to a viscoelastic polisher and a polishing method using the same.

BACKGROUND ART

A conventional viscoelastic polisher and a conventional polishing method using the polisher will briefly be described based on FIGS. 14 and 15. FIG. 14 is a plan view of the viscoelastic polisher, and FIG. 15 is a sectional view of the polisher.

In FIGS. 14 and 15, the viscoelastic polisher indicated by 51 includes a viscoelastic layer 52 provided on a surface of a metal base disk 54. The viscoelastic layer 52 has a plurality of annular grooves 53 concentrically formed therein.

A polishing operation is performed by rotating a workpiece to be polished at a predetermined rotation speed and pressing the viscoelastic polisher 51 against the workpiece at a predetermined pressure while supplying an abrasive agent to the viscoelastic layer 52 with the viscoelastic polisher 51 being rotated.

At this time, the abrasive agent held between the viscoelastic layer 52 and the to-be-polished workpiece sinks in the surface of the viscoelastic layer 52 due to the pressure. Therefore, an effective depth to which abrasive particles cut into the to-be-polished workpiece for removal of a surface portion of the workpiece is reduced. That is, the amount of the removed surface portion of the workpiece is reduced. Consequently, the surface of the workpiece is mirror-finished.

Where the polishing operation is performed by utilizing a chemical action, it is advantageous to increase the viscosity and elasticity of the viscoelastic layer 52 for increasing the period and area of contact between the abrasive agent and the to-be-polished workpiece.

Therefore, selection of a material having a higher viscosity and a higher elasticity is more advantageous for quality improvement in the polishing method utilizing the viscoelastic polisher.

In the polishing method in which the polishing operation is thus performed by pressing the to-be-polished workpiece against the viscoelastic polisher 51, the surface of the to-be-polished workpiece is kept in contact with the surface of the viscoelastic polisher, making it difficult to supply the abrasive agent to a portion of the workpiece to be actually polished.

To cope with this, the annular grooves 53 are provided in the viscoelastic layer 52 as shown in FIG. 14 (see, for example, Japanese Unexamined Patent Publication No. HEI9-295255 (1997) and Japanese Unexamined Patent Publication No. HEI10-58331 (1998))

Meanwhile, the conventional polishing method described above has the following drawbacks:

1) Reduction in polishing performance due to reduction of surface viscoelasticity associated with processing of the viscoelastic layer for formation of the grooves;

2) Increase in costs required for the processing for the formation of the grooves; and
3) Change in groove configuration due to wear with time.

Mechanical processing is mainly employed for the formation of the grooves 53 in the viscoelastic layer 52. However, it is difficult to form the grooves 53 in a soft material. Therefore, the surface hardness of the viscoelastic layer 52 is increased by pressing the viscoelastic layer to plastic deformation, and then the viscoelastic layer is processed for the formation of the grooves 53.

Therefore, the viscoelasticity is lost after the formation of the grooves 53, so that the abrasive agent sinking effect is reduced. As a result, the surface of the workpiece being polished is scratched, or the roughness of the finished surface is deteriorated.

The processing for the formation of the grooves 53 increases the costs. Further, the depth of the grooves 53 is reduced with time due to the wear of the surface of the viscoelastic layer 52, so that the effect of the provision of the grooves is reduced with time.

It is therefore an object of the present invention to provide a viscoelastic polisher and a polishing method which ensure easy maintenance of polishing performance and lower costs.

DISCLOSURE OF THE INVENTION

According to a first aspect of the present invention to solve the aforesaid drawbacks, there is provided a viscoelastic polisher which comprises a base disk and a viscoelastic layer provided on a predetermined surface of the base disk, wherein the base disk has a plurality of grooves provided in the predetermined surface thereof as extending radially outward from a center portion thereof.

In the viscoelastic polisher, the radial grooves provided in the predetermined surface of the base disk each intersect a center line passing through the center of the base disk at an angle of not greater than ±15 degrees.

With these arrangements of the viscoelastic polisher, the viscoelastic polisher can be configured so as to effectively supply an abrasive agent to a portion of a workpiece to be polished at lower costs without processing the surface of the viscoelastic layer provided on the base disk for formation of the grooves. That is, there is no need to provide the grooves in the viscoelastic layer, so that the viscoelastic layer maintains a higher viscosity and a higher elasticity, thereby ensuring enhanced polishing performance. Further, the dynamic pressure acting on the to-be-polished workpiece during polishing is reduced, so that the parallelism of the to-be-polished workpiece with respect to the viscoelastic polisher can be properly maintained. Therefore, the flatness of the polished surface can be improved. Thus, excellent polishing performance can be ensured.

Further, the angle of each of the grooves is properly adjusted so that the groove is directed along a vector obtained by combining an inertial force and a centrifugal force generated on the circumference of the base disk according to the rotation speed of the base disk, whereby the capability of supplying the abrasive agent and the capability of discharging polishing dust are improved. Thus, the polishing performance can be further improved.

In the viscoelastic polisher, the disk-shaped viscoelastic layer has a hole of a predetermined radius formed in a center portion thereof, and an inner end of each of the grooves is positioned radially outward of the hole.

With this arrangement of the viscoelastic polisher, the abrasive agent is retained in the hole formed in the center portion of the viscoelastic layer. Therefore, the abrasive agent can be efficiently supplied to a polishing portion by the centrifugal force generated by the rotation during the polishing.

In the viscoelastic polisher, a plurality of annular grooves are provided concentrically in the predetermined surface of the base disk underlying the viscoelastic layer.

With this arrangement of the viscoelastic polisher, the annular grooves are provided in addition to the radial grooves, so that the abrasive agent can be further evenly supplied. Therefore, the polishing performance can be further improved.

In the viscoelastic polisher, the viscoelastic layer is composed of a material having a multiplicity of pores at least in a surface thereof.

With this arrangement of the viscoelastic polisher, the material having the multiplicity of pores at least at the surface thereof is employed for the viscoelastic layer. Therefore, the effect of retaining the abrasive agent is excellent, and the effect of supplying the abrasive agent to the polishing portion is enhanced.

In the viscoelastic polisher, at least the surface of the viscoelastic layer is impregnated with an abrasive agent. Further, the abrasive agent mainly comprises cerium oxide.

With this arrangement of the viscoelastic polisher, the effect of supplying the abrasive agent to the polishing portion is enhanced because the abrasive agent is contained (dispersed) at least in the surface of the viscoelastic layer. Therefore, even a dry polishing operation can be performed.

Since the abrasive agent contained in the viscoelastic layer mainly comprises cerium oxide, the polishing efficiency and the finished surface roughness can be improved by the chemical action of cerium oxide particularly on glass, crystalline quartz and the like material.

According to a second aspect of the present invention, there is provided a polishing method employing the aforesaid viscoelastic polisher, the method comprising causing a rotation center of a to-be-polished workpiece to substantially coincide with a radially widthwise middle point of the viscoelastic layer when a polishing operation is performed by pressing the to-be-polished workpiece against a surface of the rotating viscoelastic polisher while rotating the workpiece.

In this polishing method, the rotation center of the to-be-polished workpiece substantially coincides with the radially middle point or a widthwise middle point of the viscoelastic layer of the viscoelastic polisher, whereby the surface of the workpiece to be polished can be kept excellent in parallelism and flatness and the finished surface roughness can be improved.

In the polishing method, the viscoelastic polisher and the to-be-polished workpiece are rotated at the same rotation speed in the same rotation direction.

In this polishing method, the distribution of a relative speed between the to-be-polished workpiece and the viscoelastic polisher can be diminished by rotating the to-be-polished workpiece and the viscoelastic polisher at the same speed in the same direction. Therefore, the flatness and parallelism of the polished surface can be improved.

In the aforesaid polishing method, the width of a trace of the rotation radius of the to-be-polished workpiece is greater than the radial width of the viscoelastic layer.

In this polishing method, partial wear of the viscoelastic layer which may occur when the to-be-polished workpiece is always offset from the viscoelastic layer can be prevented, because the width of the trace of the rotation radius of the to-be-polished workpiece is greater than the radial width of the viscoelastic layer. Therefore, the polisher can be used for a long period of time, so that running costs can be reduced.

BEST MODE FOR CARRYING OUT THE INVENTION

Viscoelastic polishers and polishing methods employing the polishers according to embodiments of the present invention will hereinafter be described. In a first embodiment, the schematic construction of a polishing apparatus will be described. In second and subsequent embodiments, viscoelastic polishers and polishing methods will be described. In the second and subsequent embodiments, differences from the first embodiment will be mainly described.

The viscoelastic polisher according to the first embodiment of the present invention and the polishing apparatus for polishing a workpiece with the use of the viscoelastic polisher will be described based on FIGS. 1 to 7.

Figure 1:
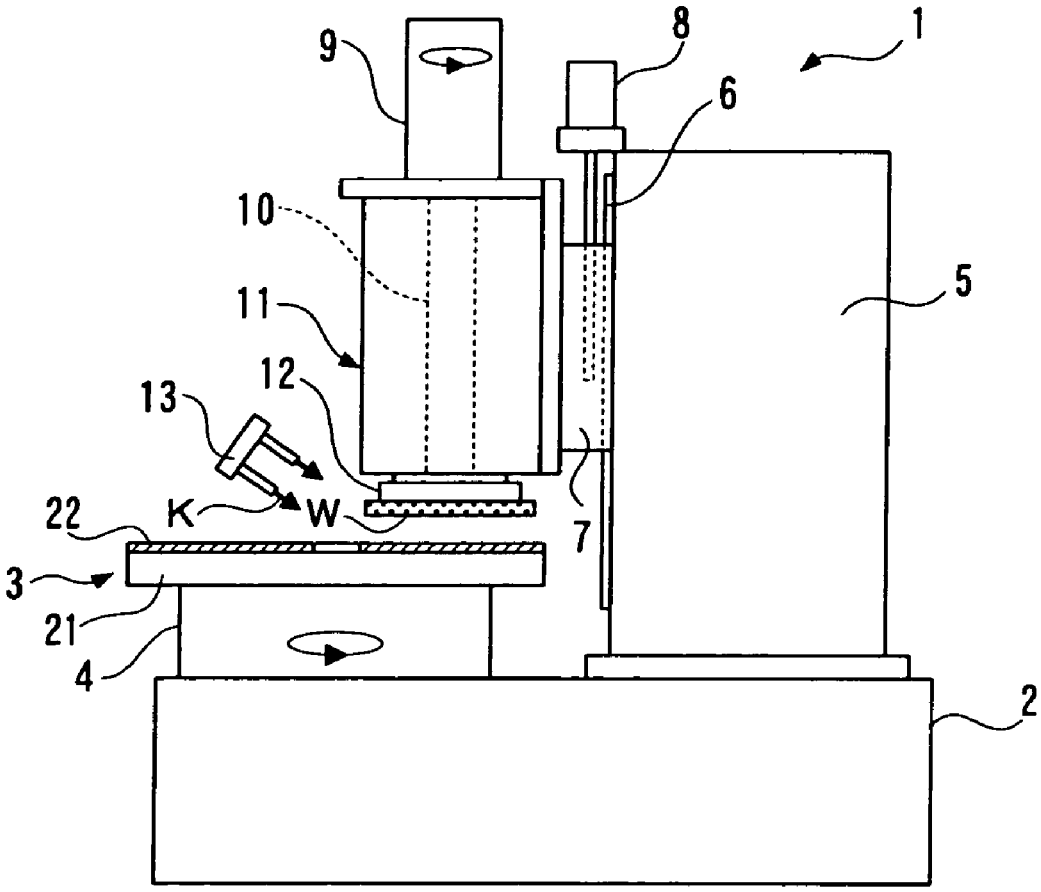
FIG. 1 is a side view of a polishing apparatus employing a viscoelastic polisher according to a first embodiment of the present invention.

First, the polishing apparatus will be explained based on FIG. 1.

The polishing apparatus 1 includes a spin base 4 provided on a bed 2 for rotating a viscoelastic polisher 3 within a horizontal plane, a support column 5 provided upright beside the spin base 4 on the bed 2, a slide member 7 attached to the support column 5 in a vertically movable manner via a vertical guide rail 6, a vertical movement motor 8 provided on an upper side of the support column 5 for vertically moving the slide member 7, for example, via a screw mechanism, a spin head 11 attached to the slide member 7 and having a rotation shaft (also referred to as "spindle") 10 to be rotated about a vertical axis by a rotation motor 9, and a chuck 12 provided at a lower end of the rotation shaft 10 of the spin head 11 for holding a workpiece W to be polished.

The polishing apparatus 1 further includes an abrasive agent supplying device 13 for supplying a liquid abrasive agent (hereinafter referred to as "polishing liquid") K to a portion of the workpiece W to be polished.

Figure 3:
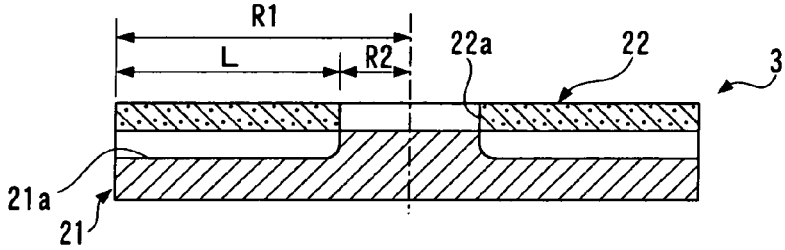
FIG. 3 is a sectional view taken along a line A-A in FIG. 2.
Figure 4:
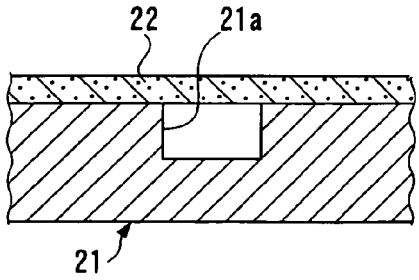
FIG. 4 is a sectional view taken along a line B-B in FIG. 2.

Next, the viscoelastic polisher will be explained based on FIGS. 2 to 4.

Figure 2:
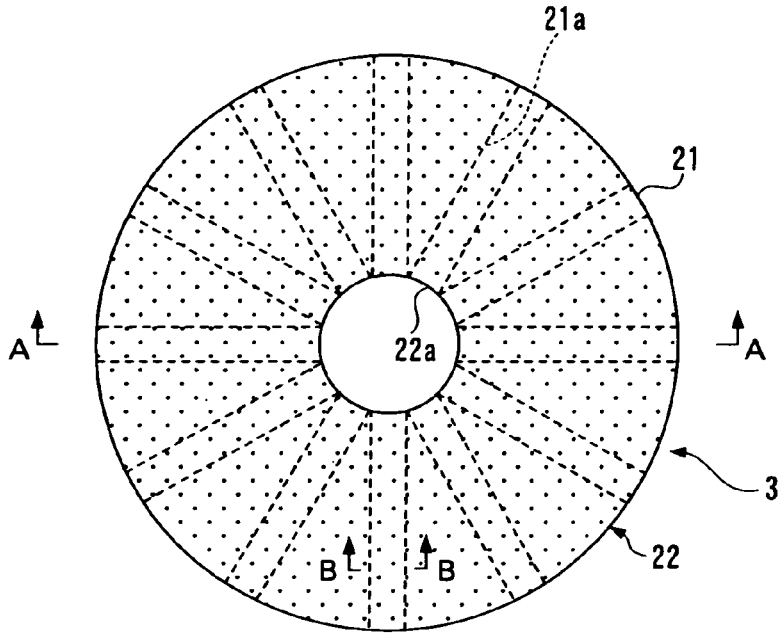
FIG. 2 is a plan view of the viscoelastic polisher according to the first embodiment.

FIG. 2 is a plan view of the viscoelastic polisher. FIG. 3 is a sectional view taken along a line A-A in FIG. 2, and FIG. 4 is a sectional view taken along a line B-B in FIG. 2.

The viscoelastic polisher 3 includes a metal base disk (an example of the base disk) 21 having a circular outer periphery of a predetermined radius (R1), and an annular viscoelastic layer 22 of a predetermined thickness fixed to a major surface (predetermined surface) of the metal base disk and having a hole 22*a* of a radius (R2) provided in a center portion thereof and a predetermined width (L=R1-R2). Further, the metal base disk 21 has a plurality of grooves (e.g., 12 grooves) of a rectangular cross section (hereinafter also referred to as "radial grooves") 21*a* equiangularly provided in the major surface of the metal base disk 21 as extending radially outward from a center portion thereof.

The viscoelastic layer 22 is a layer of a urethane rubber or suede having a raised surface or a material prepared by combining these layers (i.e., a composite material). Alternatively, a urethane rubber material having pores dispersed therein (porous material) or a material which allows for infiltration or permeation with the abrasive liquid in the presence of pores dispersed therein may be employed.

Where such a material is employed, an effect of taking the abrasive liquid (containing an abrasive material such as abrasive particles) and abrasion dust (polishing dust) into the material is provided, and the elastic modulus is improved by air contained in the pores, thereby efficiently improving the viscoelastic property. Thus, polishing performance is enhanced (improved). Further, where the abrasive material is evenly dispersed in the viscoelastic layer 22, the polishing efficiency and the polishing performance can be effectively improved. That is, the abrasive retaining effect is excellent, and even a dry polishing operation can be performed.

The abrasive material to be dispersed in the viscoelastic layer 22 may be properly selected according to the material of the to-be-polished workpiece W. Where the to-be-polished workpiece W is composed of glass or crystalline quartz, for example, cerium oxide is used as the abrasive material to be dispersed. In this case, the polishing efficiency and the finished surface roughness can be improved by a chemical action particularly on the glass, the crystalline quartz and the like.

For performing the polishing operation by means of the polishing apparatus 1, the to-be-polished workpiece W is held by the chuck 12 provided at the lower end of the rotation shaft 10. Then, the rotation shaft 10 is rotated by the rotation motor 9, and the viscoelastic polisher 3 is rotated by the spin base 4. In this state, the slide member 7 is moved down by the vertical movement motor 8, whereby the to-be-polished workpiece W is pressed against the surface of the viscoelastic polisher 3 at a predetermined pressure. At this time, an abrasive liquid K selected according to the material of the to-be-polished workpiece W is, of course, supplied to the polishing portion from the abrasive agent supplying device 13, and retained in the hole 22*a* of the viscoelastic layer 22.

Figure 5:
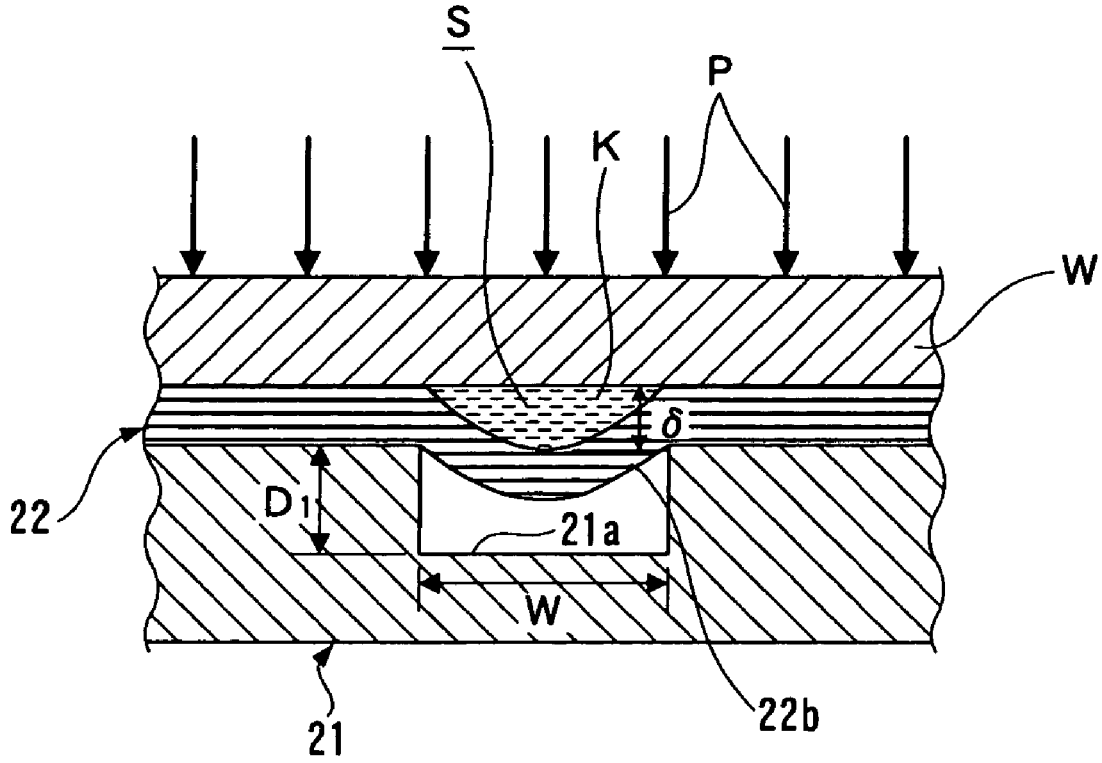
FIG. 5 is a sectional view of a major portion of the viscoelastic polisher according to the first embodiment for explaining a polishing state.

During the polishing, the pressure P acts on the to-be-polished workpiece W as shown in FIG. 5. Therefore, portions of the viscoelastic layer 22 above the grooves sag into the grooves 21*a* by a sag δ.

Therefore, the abrasive liquid K evenly spreads over the polishing surface via indentations S formed on the viscoelastic layer 22 due to the sag δ. Thus, the polishing operation is advantageously performed.

The configuration and action of the grooves 21*a* formed in the metal base disk 21 will be described more specifically.

When the predetermined pressure (load distribution) P acts on the viscoelastic layer 22 via the to-be-polished workpiece W as shown in FIG. 5, the sag δ occurs in the portions 22*b* of the viscoelastic layer above the grooves 21*a* as represented by the following equation (1):

$$\delta=5PW^4/384EI \tag{1}$$

wherein E is the Young's modulus of the viscoelastic layer 22, and I is the sectional secondary moment of the viscoelastic layer 22.

Provided that the portions of the viscoelastic layer 22 above the grooves 21*a* each have a thickness h and a width b, the sectional secondary moment I is represented by the following equation (2):

$$I=bh(b^2+h^2)/12 \tag{2}$$

The width W and depth $D_1$ of each of the grooves 21*a* are determined in consideration of the Young's modulus E of the viscoelastic layer 22. For example, the depth $D_1$ of the groove 21*a* is determined as being greater than the sag δ of the viscoelastic layer 22.

The portions 22*b* of the viscoelastic layer above the grooves 21*a* are not worn in non-contact with the to-be-polished workpiece W during the polishing, so that the thickness of the viscoelastic layer 22 is kept constant. Therefore, the sag δ occurring in the viscoelastic layer 22 can be always kept constant. That is, the sag δ always occurs as having a constant depth with respect to the to-be-polished workpiece W to allow for stable supply of the abrasive liquid K to the polishing portion.

The indentations S of the portions 22*b* of the viscoelastic layer provide not only the effect of supplying the abrasive liquid K but also the effect of capturing polishing dust generated during the polishing and discharging the polishing dust by a centrifugal force generated due to the rotation of the metal base disk 21. As a result, the polishing performance including the parallelism and flatness of the polishing surface and the finished surface roughness can be kept excellent (proper).

The depth $D_1$ of the grooves 21*a* is not necessarily required to be greater than the sag δ. Where the depth $D_1$ of the grooves 21*a* is smaller than the sag δ, however, the bottoms of the indentations of the viscoelastic layer 22 contact the grooves 21*a*. In this case, portions of the viscoelastic layer 22 adjacent to the grooves 21*a* are worn as the polishing operation is performed. Accordingly, the depth of the indentations S is reduced with time, so that the aforesaid effects are diminished. Therefore, the depth $D_1$ is preferably greater than the sag δ.

At this time, the capability of supplying the abrasive liquid K to the polishing surface is further enhanced by selecting a material infiltrative with or permeable to the abrasive liquid K for the viscoelastic layer 22. That is, the abrasive liquid K can be supplied to the indentations S by infiltration or permeation via the radial grooves 21*a*. Therefore, both the indentations S and the grooves 21*a* are utilized as supply paths for supplying the abrasive liquid K, thereby ensuring higher polishing performance.

The aforesaid effects are further enhanced by blocking the radial grooves 21*a*. That is, the centrifugal force generated by the rotation of the metal base disk 21 serves as a pressure for infiltrating or permeating the abrasive liquid K into the portions 22*b* of the viscoelastic layer above the grooves 21*a*. Portions of the radial grooves 21*a* to be blocked are preferably located on the outer periphery of the metal base disk 21 for making the best use of the centrifugal force.

Since the plurality of radial grooves 21*a* are provided, the pressure (dynamic pressure) exerted on the abrasive liquid filled between the to-be-polished workpiece W and the viscoelastic layer 22 by the rotation of the workpiece W can be more evenly distributed than in the case where the grooves 21*a* are not provided.

Figure 6A:
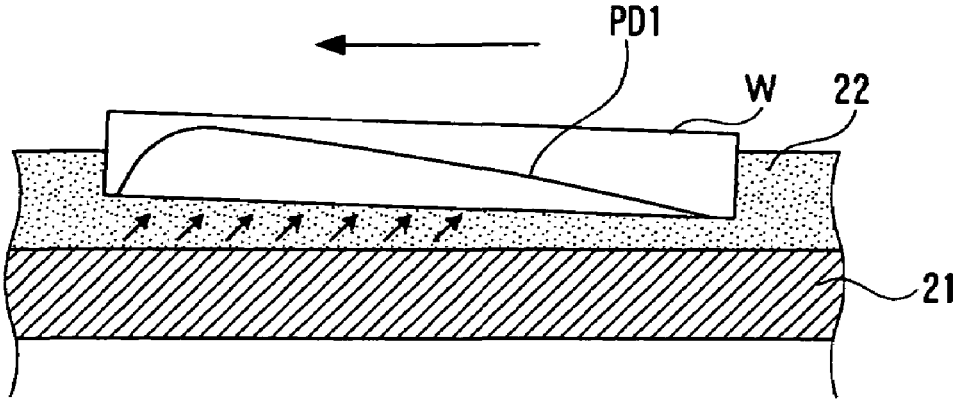
FIG. 6A PRIOR ART
FIG. 6A is a sectional view of a major portion of a prior art viscoelastic polisher for explaining the dynamic pressure distribution of a polishing liquid observed during polishing.

More specifically, where the grooves 21*a* are not provided, a pressure distribution PD1 occurs as having a pressure gradient along the entire length (diameter) of the to-be-polished workpiece W (so that a pressure at a rotation front is greater than a pressure at a tail) as shown in FIG. 6A.

Figure 6B:
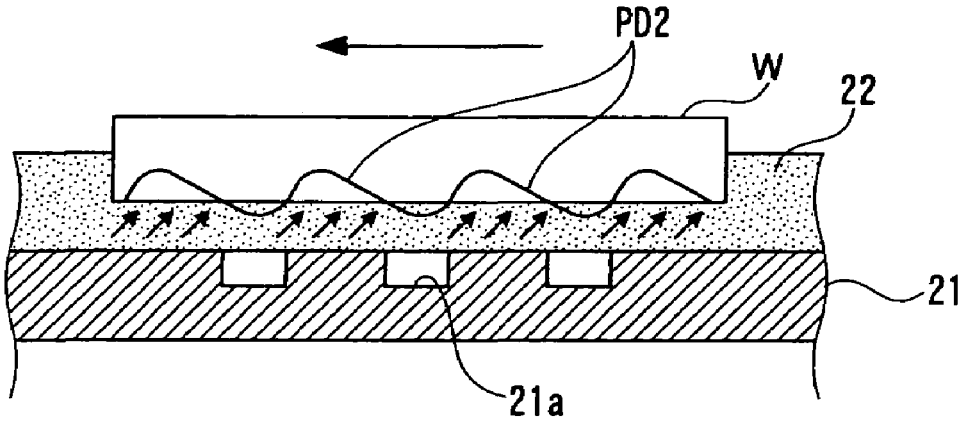
FIG. 6B is a sectional view of a major portion of the viscoelastic polisher according to the first embodiment for explaining the dynamic pressure distribution of a polishing liquid observed during polishing.
Figure 7:
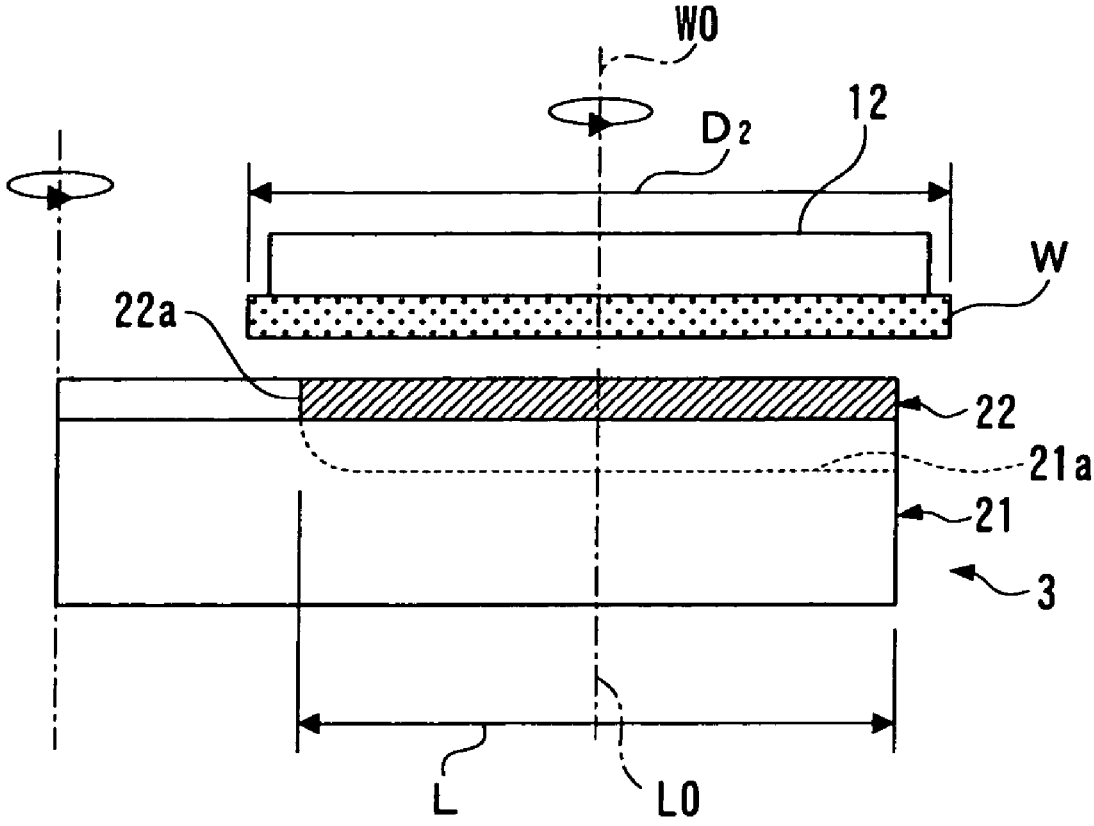
FIG. 7 is a sectional view of a major portion of the viscoelastic polisher according to the first embodiment for explaining a polishing state.

In contrast, where the grooves 21*a* are provided at predetermined intervals, the dynamic pressure distribution is such that the dynamic pressure is distributed in a plurality of parts as shown in FIG. 6B. That is, the pressure is reduced (more accurately, to a negative pressure level) at the grooves 21*a*. Therefore, a significant positive dynamic pressure acts in narrower ranges on the to-be-polished workpiece W.

Therefore, the total dynamic pressure acting on the to-be-polished workpiece W is reduced, and the parallelism of the workpiece W with respect to the viscoelastic polisher 3 is properly maintained. As a result, the flatness of the polishing surface is properly maintained, thereby improving the polishing performance.

During the polishing, the rotation center WO of the to-be-polished workpiece W (substantially) coincides with a middle point LO of the radial width L of the annular viscoelastic layer 22. Polishing conditions to be employed at this time are such that the to-be-polished workpiece W and the viscoelastic polisher 3 are rotated at (substantially) the same rotation speed in (substantially) the same rotation direction.

Thus, the distribution of a relative speed between the to-be-polished workpiece W and the viscoelastic polisher 3 is kept constant irrespective of the position within the plane of the workpiece W. Therefore, the parallelism and flatness of the polished surface of the workpiece W after the polishing operation are drastically improved.

The outer diameter D2 of the to-be-polished workpiece W (equivalent to the width of a trace of the rotation radius of the workpiece W) is set greater than the width L of the viscoelastic layer 22, whereby the partial wear of the viscoelastic layer 22 can be prevented.

With the aforesaid arrangement of the viscoelastic polisher 3, the grooves 21*a* are provided in the major surface of the metal base disk 21, thereby providing substantially the same effects as in the case where the grooves are provided in the viscoelastic layer 22. That is, there is no need to form the grooves in the viscoelastic layer 22, so that the intrinsic properties of the viscoelastic layer can be utilized. Further, there is no need to process the viscoelastic layer for the formation of the grooves, so that the production costs of the viscoelastic polisher 3 can be reduced.

Further, the depth of the grooves 21*a* formed in the metal base disk 21 does not depend on the wear to be caused by the polishing operation and, hence, is kept constant. Therefore, the polishing performance is stabilized.

Since the viscoelastic layer 22 of the viscoelastic polisher 3 has the hole 22*a* provided at the center thereof, the abrasive liquid K supplied to the polishing portion is retained in the hole 22*a*. Therefore, the abrasive liquid K can be constantly supplied radially outward from the center. Further, the abrasive liquid K is supplied via the indentations S formed in the portions 22*b* of the viscoelastic layer above the grooves 21*a*. Thus, the abrasive liquid can be stably supplied.

Next, a viscoelastic polisher according to the second embodiment of the present invention will be described based on FIGS. 8 to 10.

The viscoelastic polisher according to the second embodiment includes a plurality of annular grooves concentrically provided in addition to radial grooves as provided in the viscoelastic polisher according to the first embodiment described above. In the second embodiment, only a difference from the first embodiment will be mainly described. The same components as those in the first embodiment are denoted by the same numerals, and no explanation will be given thereto.

Figure 8:
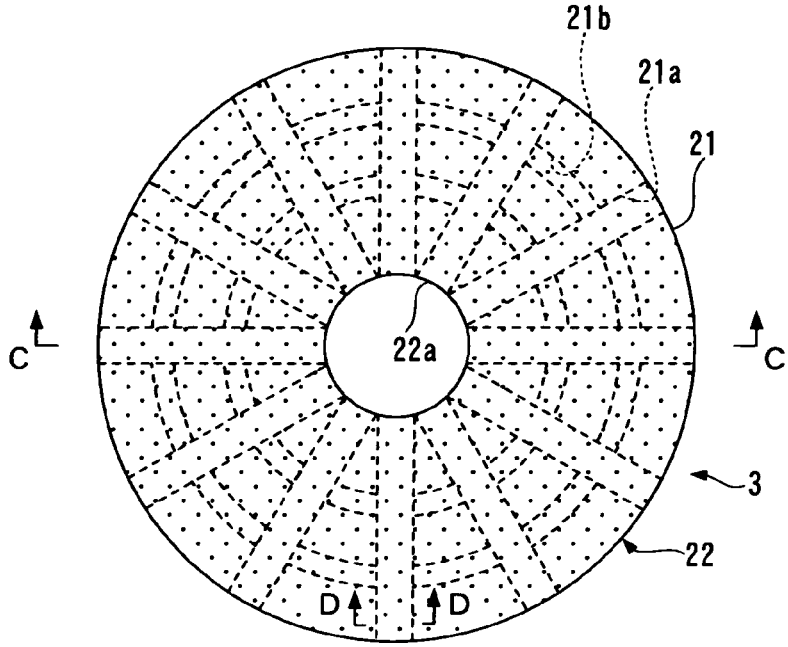
FIG. 8 is a plan view of a viscoelastic polisher according to a second embodiment of the present invention.
Figure 9:
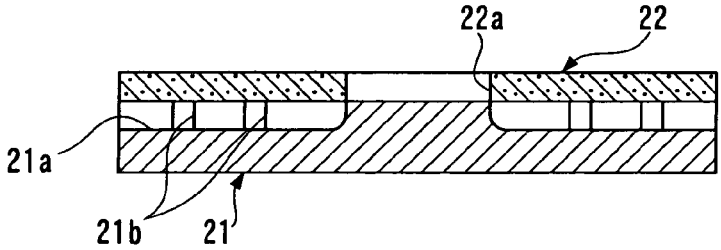
FIG. 9 is a sectional view taken along a line C-C in FIG. 8.
Figure 10:
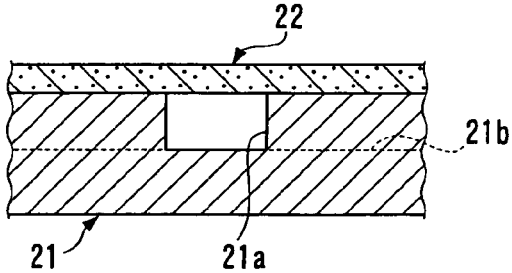
FIG. 10 is a sectional view taken along a line D-D in FIG. 8.

As shown in FIGS. 8 to 10, the metal base disk 21 has a plurality of annular grooves (e.g., two annular grooves) 21*b* having different radii and concentrically provided in the major surface (predetermined surface) thereof in addition to the radial grooves 21*a*. The annular grooves 21*b* each have the same depth as the radial grooves 21*a*, and have a width slightly smaller than that of the radial grooves 21*a*.

Since the plural annular grooves 21*b* are concentrically provided in addition to the radial grooves 21*a*, the same effects as in the first embodiment can be provided. Further, the number of the grooves for supplying the abrasive liquid K to the to-be-polished workpiece W is virtually increased, thereby improving the polishing performance. Even where a spiral groove is provided instead of the concentric annular grooves 21*b*, the same effects are provided.

Next, a viscoelastic polisher according to the third embodiment will be described based on FIGS. 11 to 13.

In the viscoelastic polisher according to the third embodiment, radial grooves provided in the viscoelastic polisher as in the first embodiment described above are each inclined with respect to the radius (center line) of the polisher. In the third embodiment, only a difference from the first embodiment will be mainly described. The same components as those in the first embodiment are denoted by the same numerals, and no explanation will be given thereto.

Figure 11:
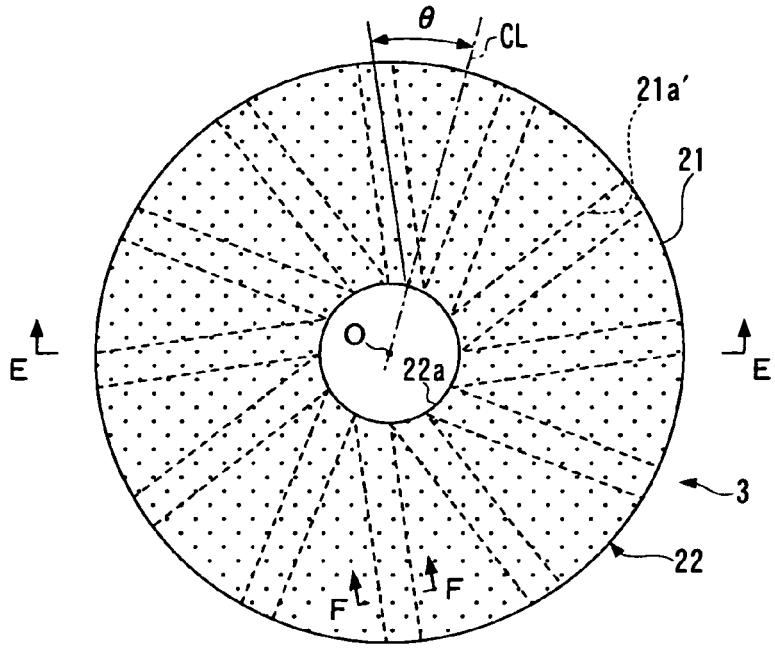
FIG. 11 is a plan view of a viscoelastic polisher according to a third embodiment of the present invention.
Figure 12:
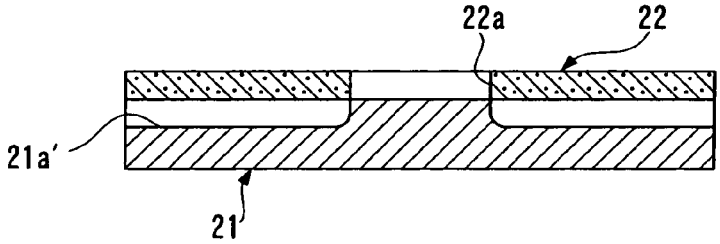
FIG. 12 is a sectional view taken along a line E-E in FIG. 11.
Figure 13:
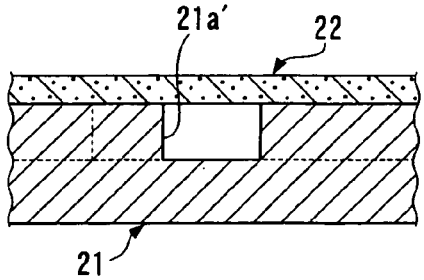
FIG. 13 is a sectional view taken along a line F-F in FIG. 11.
Figure 14:
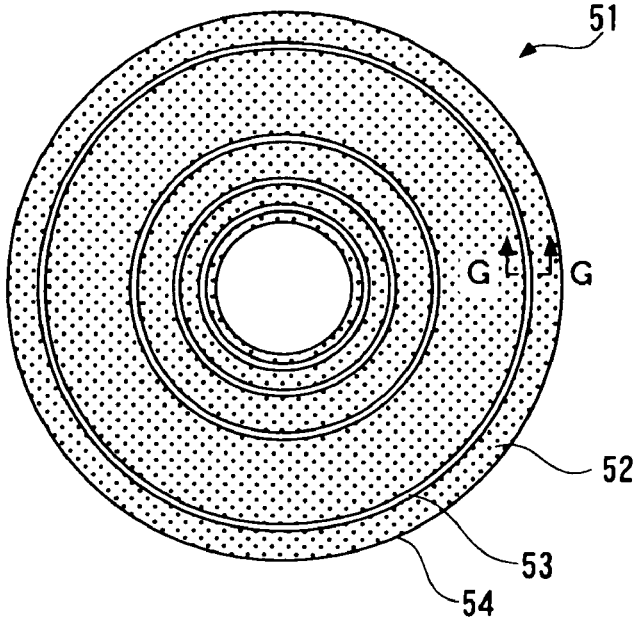
FIG. 14 PRIOR ART
FIG. 14 is a plan view of the prior art viscoelastic polisher for polishing.
Figure 15:
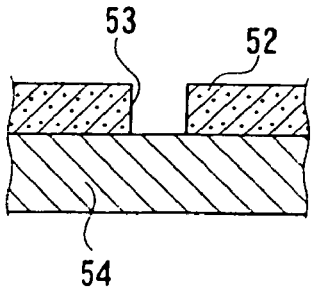
FIG. 15 PRIOR ART
FIG. 15 is a sectional view taken along a line G-G in FIG. 14.

As shown in FIGS. 11 to 13, a plurality of radial grooves 21*a*' are equiangularly provided in the major surface (predetermined surface) of the metal base disk 21 as intersecting a center line CL passing through the center O of the metal base disk 21 at an angle θ of not greater than ±15 degrees. That is, the grooves are each inclined at the predetermined angle θ with respect to the radius or the center line CL.

In this case, the same effects as in the first embodiment are provided.

Particularly where a vector obtained by combining an inertial force and a centrifugal force generated at a point on the circumference of the viscoelastic polisher 3 by the rotation during the polishing is directed at the intersection angle θ along the radial groove 21*a*', the flow rate of the abrasive liquid K flowing through indentations S formed in portions 22*b* of the viscoelastic layer above the grooves 21*a*' is increased. As a result, the supply amount of the abrasive liquid K can be increased. Therefore, the polishing performance can be further improved.

This arrangement is applied to the case where the grooves extend radially from the rotation center of the viscoelastic polisher 1. Application of this arrangement to the case where the concentric annular grooves are provided in combination with the radial grooves as in the second embodiment is effective for the reduction of the dynamic pressure and the stable supply of the abrasive liquid.

With the aforesaid arrangements, the radial grooves are provided in the metal base disk on which the viscoelastic layer is fixed. Thus, the viscoelastic polisher and the polishing method which ensure higher polishing performance can be provided at lower costs without the need for the provision of the grooves in the viscoelastic layer.

Where the radial grooves provided in the metal base disk each intersect the center line at an angle of −15 degrees to +15 degrees, i.e., at an angle of not greater than +15 degrees, the viscoelastic polisher can be provided which ensures efficient polishing even under high speed rotation.

With the use of the aforesaid viscoelastic polisher, the polishing operation is performed with the rotation center of the to-be-polished workpiece (substantially) coinciding with the radially middle point of the viscoelastic layer. Thus, the polishing method can be provided which is excellent in polishing performance including the parallelism and flatness of the surface of the workpiece to be polished and the finished surface roughness.

INDUSTRIAL APPLICABILITY

In the viscoelastic polisher, the grooves effective for supplying the abrasive liquid are provided in the metal base disk and, therefore, the production costs are reduced. The viscoelastic polisher is advantageous for polishing a disk plate such as of a metal.

The invention claimed is:

1. A viscoelastic polisher comprising:

a base disk having a plurality of grooves a surface thereof, the grooves extending radially outward from a center portion of the surface of the base disk; and a viscoelastic layer on the surface of the disk, the viscoelastic layer having no grooves therein, being adjacent to said grooves of the base disk, and having a hole in a center portion corresponding to the center portion of the base disk, wherein the viscoelastic layer is for directly contacting a to-be-polished workpiece, for thereby polishing the to-be-polished workpiece.

2. The viscoelastic polisher according to claim 1, wherein the radial grooves in the surface of the base disk each intersect a center line passing through a center of the base disk at an angle of not greater than ±15 degrees.

3. The viscoelastic polisher according to claim 1, wherein an inner end of each of the grooves of the base disk is positioned radially outward of the hole of the viscoelastic layer.

4. The viscoelastic polisher according to claim 1, wherein a plurality of annular grooves are provided concentrically in the predetermined surface of the base disk underlying the viscoelastic layer.

5. The viscoelastic polisher according to claim 1, wherein the viscoelastic layer comprises a material having a multiplicity of pores at least in a surface thereof.

6. The viscoelastic polisher according to claim 1, wherein at least a surface of the viscoelastic layer is impregnated with an abrasive agent.

7. The viscoelastic polisher according to claim 6, wherein the abrasive agent mainly comprises cerium oxide.

8. A polishing method employing a viscoelastic polisher according to claim 1, wherein the method comprises causing a rotation center of a to-be-polished workpiece to substantially coincide with a middle point of a radius of the viscoelastic layer when a polishing operation is performed by pressing the to-be-polished workpiece against a surface of the rotating viscoelastic polisher while rotating the workpiece.

9. The polishing method according to claim 8, wherein the viscoelastic polisher and the to-be-polished workpiece are rotated at the same rotation speed in the same rotation direction.

10. The polishing method according to claim 8, wherein a width of a trace of a rotation radius of the to-be-polished workpiece is greater than a radial width of the viscoelastic layer.

11. The viscoelastic polisher according to claim 1, wherein the grooves have a substantially rectangular shape.

12. The viscoelastic polisher according to claim 1, wherein an outer circumferential end of the grooves is blocked.

13. The viscoelastic polisher according to claim 1, wherein the center portion of the base disk is raised relative to the grooves, and the center of the base disk is exposed via the hole in the viscoelastic layer.

14. A polishing method using the polisher according to claim 1, the method comprising:

introducing an abrasive agent into the hole in the center of the viscoelastic layer; and pressing an object-to-be-polished against the viscoelastic layer, wherein pressing the object-to-be-polished against the viscoelastic layer creates indentations in the viscoelastic layer corresponding to the grooves in the base disk, the abrasive agent enters the indentations such that it is between the object-to-be-polished and the indented surface of the viscoelastic layer, and the abrasive agent enters the grooves of the base disk, thereby lubricating the viscoelastic layer.

* * * * *